US007097372B1

(12) United States Patent
Heyse et al.

(10) Patent No.: US 7,097,372 B1
(45) Date of Patent: Aug. 29, 2006

(54) REFILLABLE TAPE CASSETTE

(75) Inventors: Geert Heyse, Katelijne Waver (BE); Robert Day, Cambridge (GB); Charles Robert Sims, Hertfordshire (GB)

(73) Assignee: Esselte N.V., Sint Niklaas (BE)

( * ) Notice: Subject to any disclaimer, the term of this patent is extended or adjusted under 35 U.S.C. 154(b) by 0 days.

(21) Appl. No.: 09/182,499

(22) Filed: Oct. 30, 1998

(30) Foreign Application Priority Data

Nov. 27, 1997 (EP) ..... 97120793

(51) Int. Cl.
*B41J 15/02* (2006.01)
*B41J 15/04* (2006.01)

(52) U.S. Cl. ..... 400/613; 400/614

(58) Field of Classification Search ..... 400/207, 400/208, 208.1

See application file for complete search history.

(56) References Cited

U.S. PATENT DOCUMENTS

| | | | | | |
|---|---|---|---|---|---|
| 4,490,761 | A | * | 12/1984 | Wolynski et al. | 360/128 |
| 4,605,325 | A | | 8/1986 | Hofmann | 400/207 |
| 5,073,052 | A | | 12/1991 | Daley et al. | 400/208 |
| 5,433,540 | A | | 7/1995 | Alday | 400/250 |
| 5,456,545 | A | | 10/1995 | Sims et al. | 400/708 |
| 5,492,282 | A | * | 2/1996 | Okuchi et al. | 242/341 |
| 5,500,669 | A | * | 3/1996 | Yamashita et al. | 347/214 |
| 5,553,952 | A | * | 9/1996 | Umbach | 400/208 |
| 5,788,387 | A | * | 8/1998 | Takayama et al. | 400/586 |
| 5,813,774 | A | * | 9/1998 | Sone et al. | 400/250 |

FOREIGN PATENT DOCUMENTS

| | | |
|---|---|---|
| DE | 3705056 A1 | 9/1988 |
| EP | 0 526 078 A2 | 2/1993 |
| EP | 0 551 208 A2 | 7/1993 |
| EP | 0 555 954 A2 | 8/1993 |
| EP | 0 629 509 A2 | 12/1994 |

OTHER PUBLICATIONS

Patent Abstracts of Japan, 02048981, Feb. 19, 1990, Umehara Kenji, Loading Method for Ink Ribbon.

* cited by examiner

*Primary Examiner*—Daniel J. Colilla
(74) *Attorney, Agent, or Firm*—Marshall, Gerstein & Borun LLP

(57) ABSTRACT

The present invention relates to a refillable tape cassette for accomodating a supply of printable tape. In order to avoid the need for different tape cassettes for different tape widths the tape cassette is capable of selectively housing supplies of tapes of different widths. Alternatively or additionally, the tape cassette can have a housing comprising a base on which the tape supply can be releasably fixed, and a lid fixed to the base, wherein the lid is pivotally mounted to the base by means of a hinge, Further, according to the invention, the windings of refill tape units are held together by means of a strip of adhesive or by means of wax on the axial ends of the units, or by scuffing the backing layer of an image receiving tape which is broader than the image receiving layer.

21 Claims, 9 Drawing Sheets

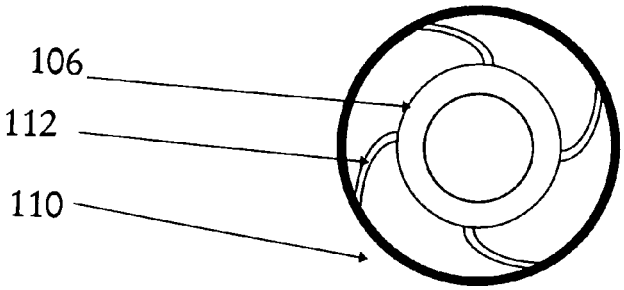
Fig. 9 a
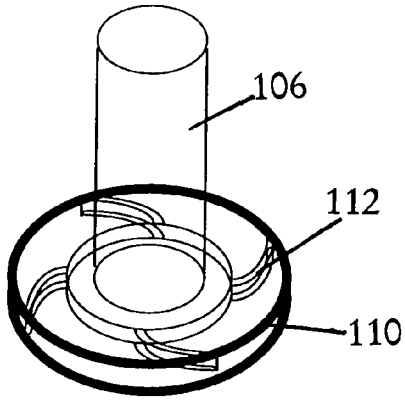
Fig. 9 b
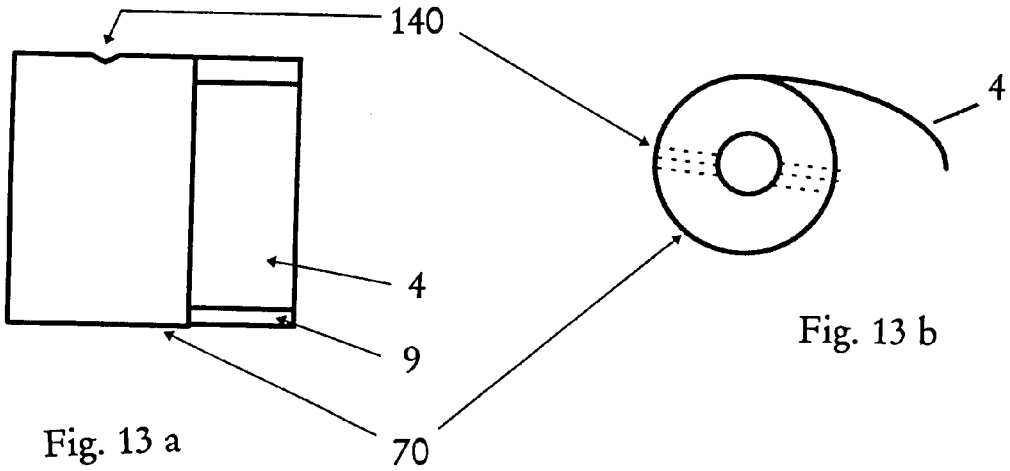
Fig. 13 a
Fig. 13 b

Fig. 11 a
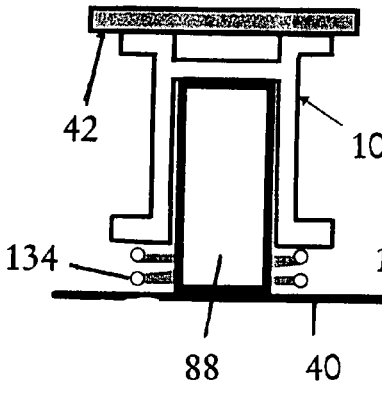
Fig. 11 b
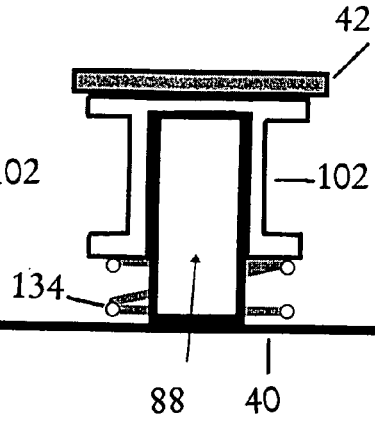
Fig. 11 c
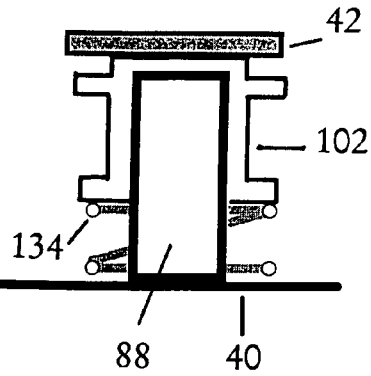
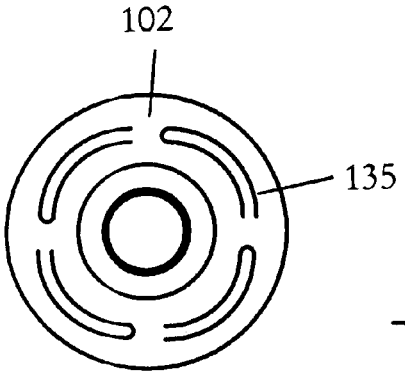
Fig. 12 a
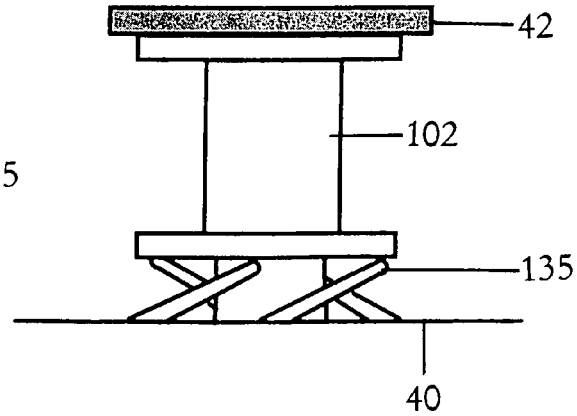
Fig. 12 b

REFILLABLE TAPE CASSETTE

BACKGROUND OF THE INVENTION

1. Field of the Invention

The present invention relates to a cassette for a tape printer.

2. Background Art

Known tape printing apparatus of the type with which the present invention is generally concerned are disclosed in published European Patent Applications EP-A-0 322 918 and EP-A-0 322 919 (Brother KK) and EP-A-0 267 890 (Varitronic). The printers each include a printing device having a cassette receiving bay for receiving a cassette or tape holding case. In EP-A-0 322 918, the tape holding case houses an ink ribbon, a transparent image receiving tape and a double-sided adhesive tape which is secured at one of its adhesive coated sides to the image tape after printing and which has a backing paper peelable from its other adhesive side. With both these apparatus, the image transfer medium (ink ribbon) and an image receiving tape (substrate) are in the same cassette.

The present invention was developed as a different type of tape printing apparatus which is described for example in U.S. Pat. No. 5,456,545. In this printing apparatus, the substrate tape is similar to that described in EP-A-0 267 890 (ie. comprises an image receiving layer and a releasable backing layer) but is housed in its own tape holding case while the image transfer ink ribbon is similarly housed in its own tape holding case.

In all of these cases, the image receiving tape passes in an overlap manner with the ink ribbon to a print zone consisting of a fixed print head and a platen against which the print head can be pressed to cause an image to transfer from the ink ribbon to the image receiving tape. There are many ways of doing this, including dry lettering or dry film impression, but the most usual way at present is by thermal printing where the print head is heated and the heat causes ink from the ink ribbon to be transferred to the ink receiving tape. Alternatively, the print head may be in direct contact with a thermally sensitive image receiving tape whereby when the print head is heated, an image is defined on the image receiving tape.

A disadvantage of the known tape cassettes is that once the supply of tape housed in the cassette is printed, the user needs to buy an entirely new cassette, while the empty cassette is discarded. In order to avoid wastage of material, it has thus been proposed to have refillable cassettes, into which the user can insert new printing tape and/or ink ribbon. Such cassettes are described eg. in European Patent Applications EP-A-0 625 427, EP-A-0 629 509, EP-A-0 630 756, EP-A-0 633 141, EP-A-0 635 375, EP-A-0 694 415, EP-A-0 704 311, EP-A-0 734 878, EP-A-0 790 134, and German Patent DE-U-295 20 421.

Such cassettes allow the user to use one tape cassette with a multiplicity of image receiving tapes and/or image transfer tapes (ink ribbon). A disadvantage is however that the refillable cassettes known in the prior art only allow inserting certain width of tape. Thus, a user needs a relatively high number of tape cassettes, since this number equals the number of different tape width which are intended to be used.

SUMMARY OF THE INVENTION

An object of the present invention is thus to provide a refillable tape cassette which avoids the need for different cassettes for distinct tape widths.

According to a first aspect of the present invention, there is provided a tape cassette for accomodating a supply of printable tape, the tape cassette being suitable for being detachably loaded in a tape printing device, said tape cassette having means for inserting and removing a tape supply into the tape cassette, and wherein the tape cassette is capable of selectively accomodating tape supplies of different tape widths.

The idea of the present invention is to provide a single tape cassette which is capable of selectively housing tape supplies of different width. Thus, the user can fill his refillable tape cassette through an appropriate opening in the tape supply of the desired tape width. The tape cassette has hence means for accomodating tape supplies of different width. The tape can be an ink ribbon tape and/or an image receiving tape comprising an image receiving layer and a releasable backing layer.

In order to selectively accomodate tapes of different width, it is necessary to define the plane in which the tape is located within the cassette. It is thus proposed that the tape be wound onto a bobbin which is releasably accomodated on a post provided within the cassette, the post comprising a datum surface which interacts with a surface of said bobbin such that it defines the position of the bobbin in the axial direction of the post. Further, the post or the bobbin can comprise a rib mating with an internal flange of the bobbin or the post, so that the bobbin is releasably retained on the post.

It is preferred that bobbins with tape supplies of different tape widths have surfaces interacting with the datum surface of the post, wherein the surfaces are positioned so that the center line of the tapes of different width is located in the same plane, independent of the width of the tape.

In order to achieve good printing quality, it is necessary to provide a back tension in the tape. Thus, a spring may be provided between a bobbin onto which the tape is wound and a part of the housing of the tape cassette, the spring slipping on the housing and/or on the bobbin and providing back tension in the tape. When the spring interacts with a flange of the bobbin, and the relative position of the flange with respect to the post and thus the backward tension of the tape provided by the spring depends on the width of the tape, it is possible to have an appropriate tension in the tape, which depends on the tape width. The spring may be unitary with the bobbin or the housing of the tape cassette.

The housing of the tape cassette can have different forms. It can consist of a base on which the tape supply can be releasably fixed, the base having a bottom surface extending parallel to the center plane of the tape supply, the tape supply being releasably retained on the bottom surface, and wherein the tape supply is freely accessible from the side opposite the bottom surface, the cassette thus having the form of an open chassis without a lid.

Alternatively, the cassette has a housing comprising a base on which the tape supply can be releasably fixed, the base having a bottom surface extending orthogonally to the center plane of the tape supply, the tape supply being releasably retained on the bottom surface, and wherein the tape cassette comprises a lid opposite the bottom surface, wherein the distance between the bottom surface and the lid varies with the width of the tape. In this case, a pin can connect base and lid and provide a guidance for the lid on the base. The lid can be held in position by means of a clip which can be accomodated on corresponding surfaces of the base or the lid, and secures the lid to the base, whereby the respective surface with which the clip interacts depends on the width of the tape. It is further possible to have a plurality of such clips, whereby it depends on the tape width which one of the clips is interacting with the lid.

When a thermal transfer printing process is performed in the tape printing device, it is necessary to provide an ink ribbon. This ink ribbon can be located in its own cassette (see U.S. Pat. No. 5,456,545), or in the same cassette as the image receiving tape. In both cases the ink ribbon tape is wound on a supply spool, and its leading end is connected to a take-up spool. Since the ink ribbon must follow a predetermined path such that printing can take place with high quality, it is necessary to insert it appropriately into the cassette. This can be done manually by the user, or the supply spool and the take-up spools can be fixed to a holder such that their relative position corresponds to their position when they are inserted in the tape cassette. The holder thus facilitates insertion of the ink ribbon into the cassette. It can additionally define the path of the ink ribbon tape, such that the path corresponds to the path of the ink ribbon when it is inserted into the tape cassette. In order to prevent unintended rotation of the spools, it is proposed that they are releasably secured by the holder against rotation (and hence unwinding), such that the cassette is in an operable state when the ink ribbon is mounted in the tape cassette, but released from the holder. In a preferred embodiment, the ink ribbon supply spool and the ink ribbon take-up spool are fixed to the holder by means of a tear-off tape. Further, the holder may comprise a lid covering at least a part of said tape cassette.

In another embodiment of the present invention, the tape cassette has a housing comprising a base on which the tape supply can be releasably fixed, the base having a bottom surface extending orthogonally to the center plane of the tape supply, wherein the tape cassette comprises a lid opposite the bottom surface, whereby the tape supply is releasably fixed to the lid. The user can thus grip the lid with the tape, and simply insert it into the base of the tape cassette. The lid can comprise material (paper, cardboard or plastics) between the tape supply and the outer surface of the lid such that the distance between the bottom of the tape cassette and the outer surface of the lid is independent of the width of the tape.

According to a second aspect of the present invention, there is provided a tape cassette for accomodating a supply of printable tape, the tape cassette being suitable for being detachably loaded in a tape printing device, wherein the tape cassette has a housing comprising a base on which the tape supply can be releasably fixed, and a lid fixed to the base, wherein the lid is pivotally mounted to the base by means of a hinge.

The tape cassette thus only consists of a single part, since the lid and the base are fixed together. This makes handling relatively easy. For the sake of reduction of production costs, the base, the lid, and the hinge can be unitary, i.e. moulded in as a single part.

According to a third aspect of the present invention, there is provided a tape supply unit comprising a wound tape, the tape unit being suitable for being detachably loaded in a tape cassette and/or in a tape printing device, wherein the respective windings of the tape are held together by means of a strip of wax or adhesive provided on the axial end or ends of the tape supply unit.

According to a fourth aspect of the present invention, there is provided a tape supply unit comprising a wound image receiving tape, the tape unit being suitable for being detachably loaded in a tape cassette and/or in a tape printing device, wherein the image receiving tape comprises an image receiving layer of a first width and a releasable backing layer of a second width, the second width being larger than the first width, and wherein the axial end or ends of the tape supply unit are scuffed such that the respective windings of the tape are held together.

The third and fourth aspect are thus directed towards the tape supply units as such. In order to prevent unwinding, what is in the state of the art usually performed by foils adhered to the axial ends of the units, or by a strip of adhesive tape connecting the leading end of the tape to the spools, it is proposed to have a strip of wax or adhesive on the axial ends of the tape supply, or to scuff the backing of the image receiving tape, whereby the backing is wider than the image receiving layer.

BRIEF DESCRIPTION OF THE INVENTION

For a better understanding of the present invention and as to show how the same may be carried into effect, reference will now be made to the accompagnying drawings in which.

Figure 3A:
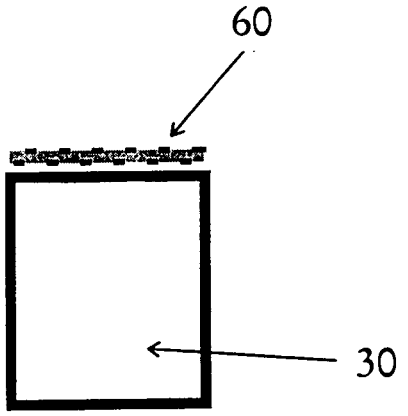
Figure 3B:
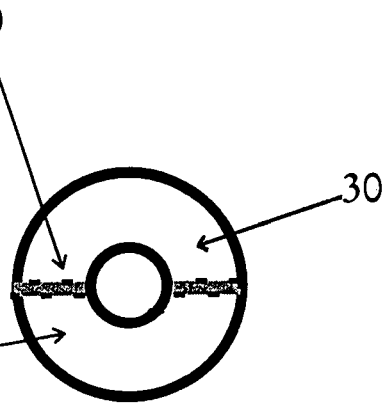
Figure 4:
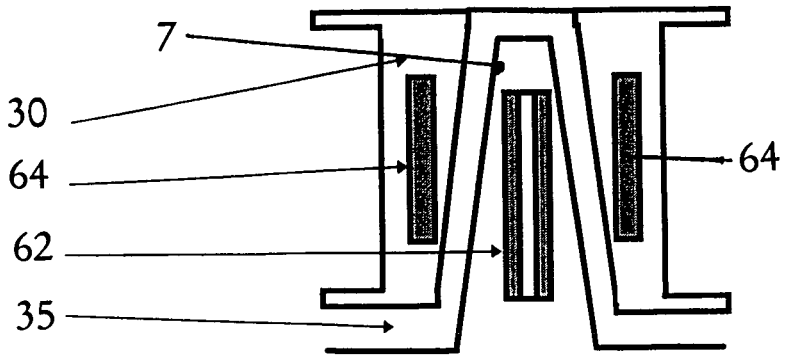
Figure 5:
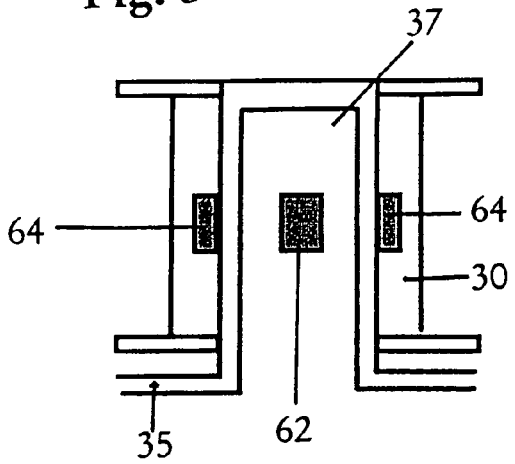
Figure 6:
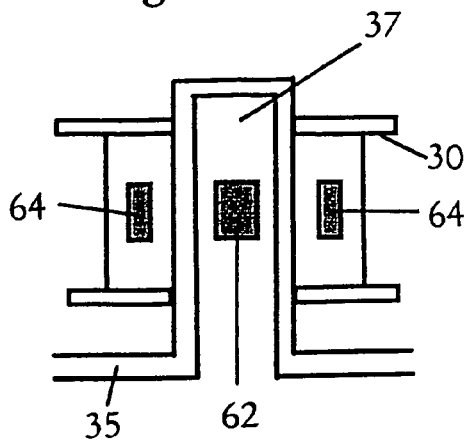
Figure 7:
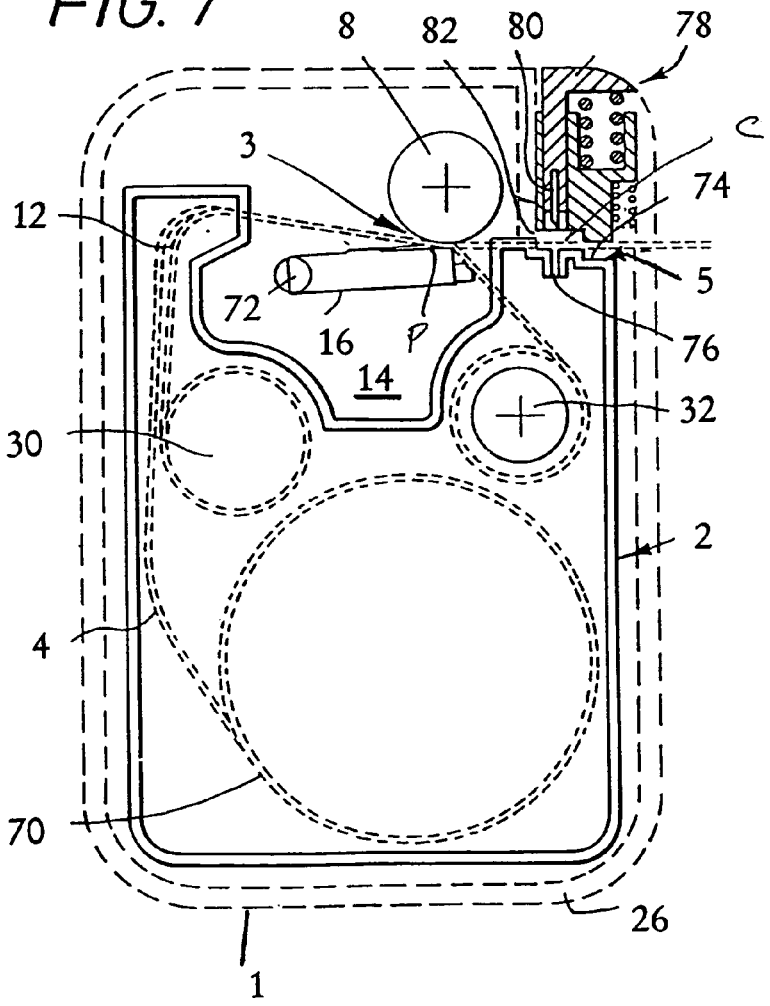
Figure 8:
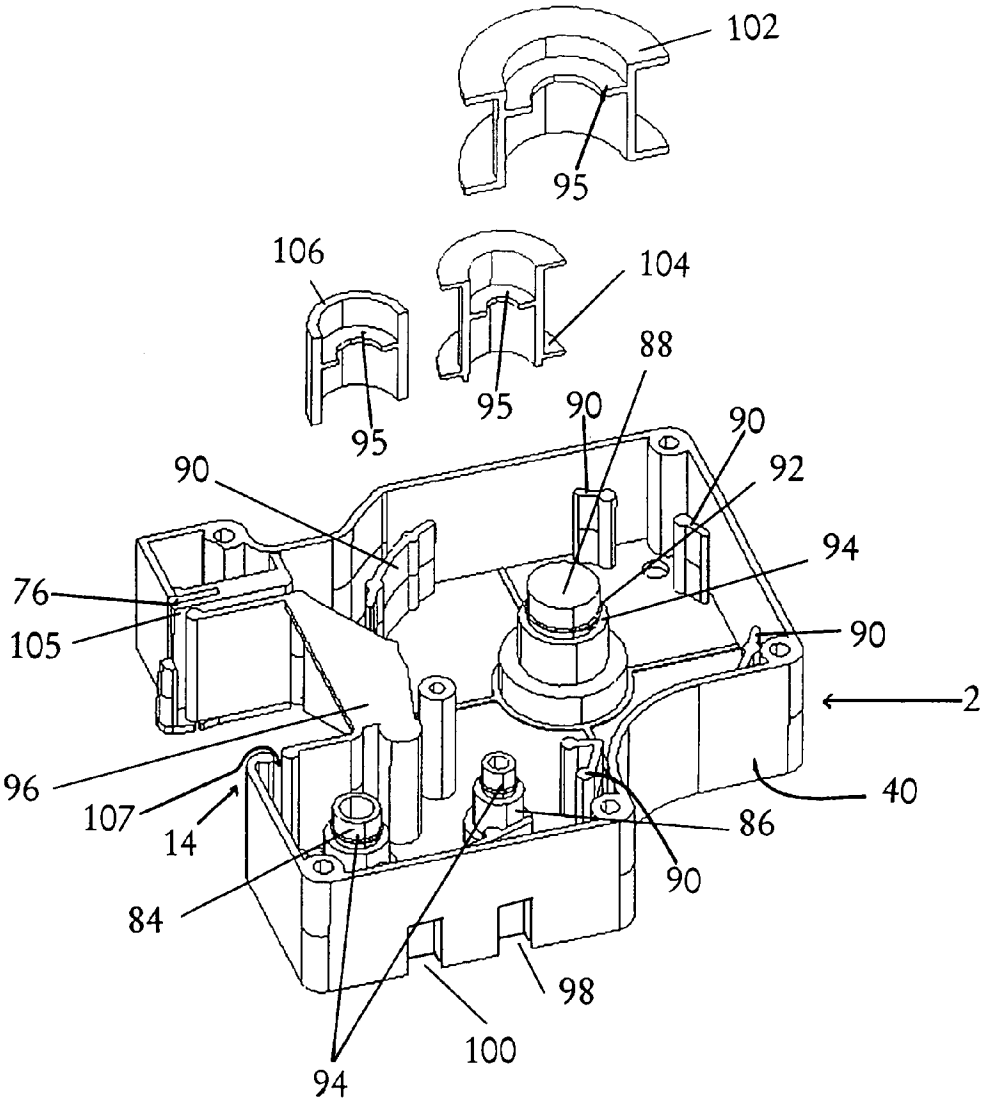
Figure 10:
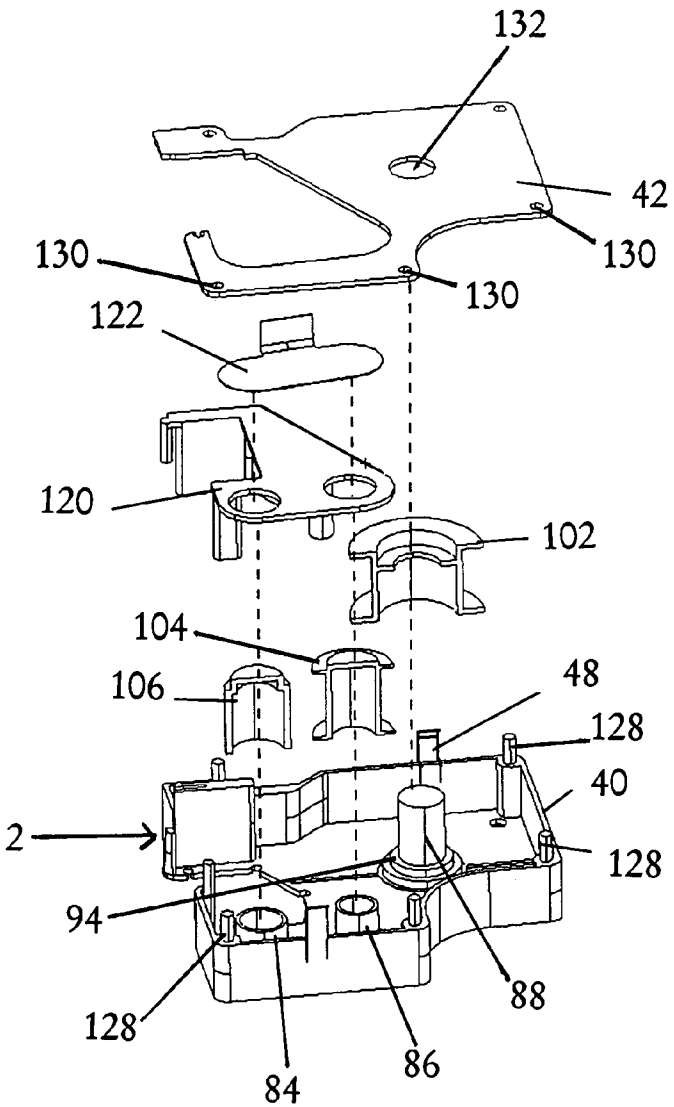
Figures 14A, 14B, 14C, 14D:
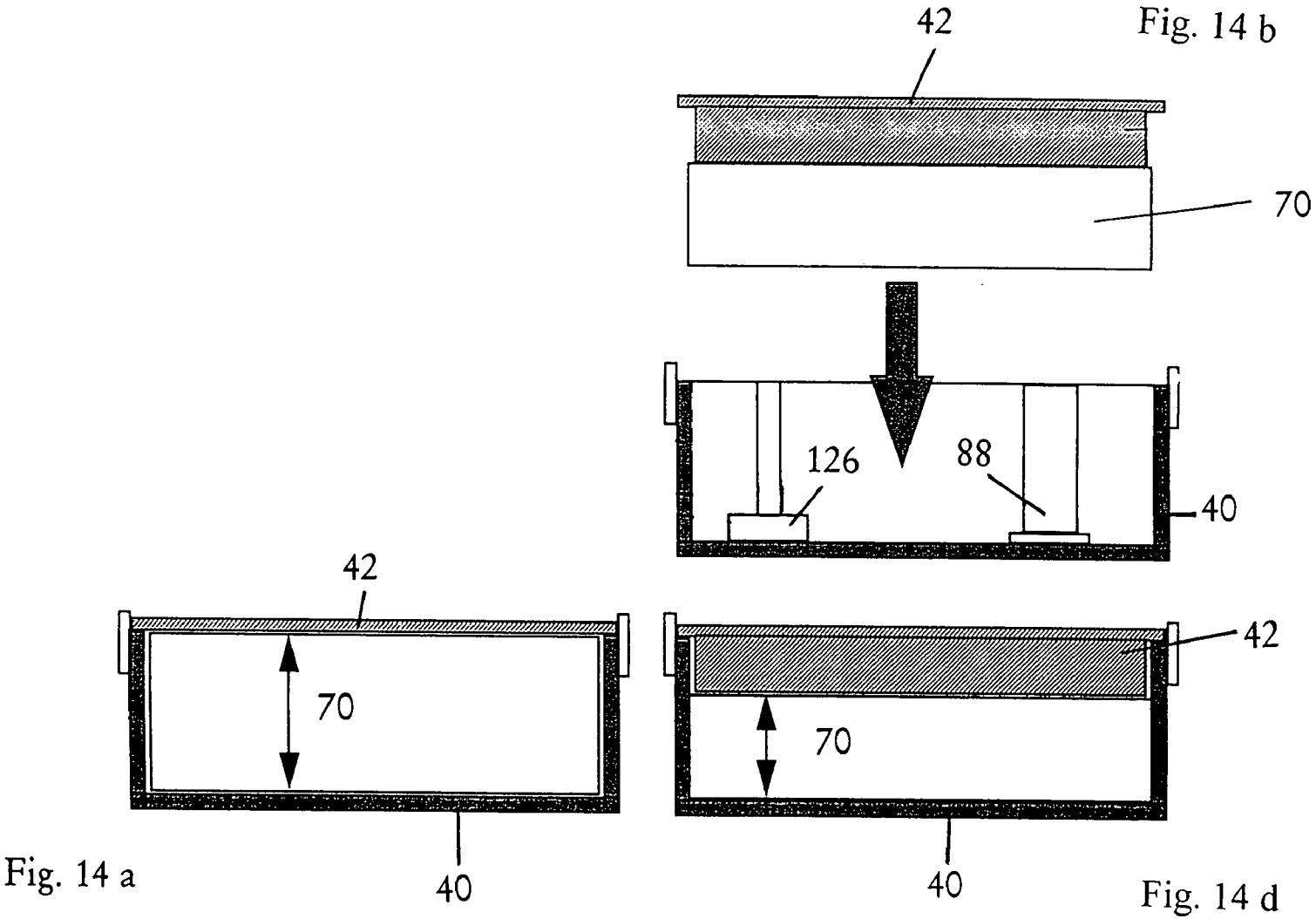

FIG. 3*a* is a side view of a tape supply spool;

FIG. 3*b* is a top view of a tape supply spool;

FIG. 4 is a view of a tape supply together with its support;

FIG. 5 is a view of a broad tape supply together with its support;

FIG. 6 is a view of a narrow tape supply together with its support;

FIG. 7 is a plan view showing a cassette according to another embodiment of the present invention inserted into a printing device;

FIG. 8 is a perspective view of a cassette of FIG. 7;

FIG. 9*a* is a bottom view of a tape spool of the cassette of FIG. 8;

FIG. 9*b* is a perspective view of a tape spool of the cassette of FIG. 8;

FIG. 10 is a perspective view of another cassette insertable into the printing device of FIG. 7;

FIG. 11*a–c* are sections through a bearing of the tape supply of the cassette of FIG. 10;

FIGS. 12*a* and *b* are sections through bearings of the tape supply of the cassette of FIG. 10;

FIGS. 13*a* and 13*b* are views of the tape spool for use in the cassette of FIG. 10; and FIGS. 14*a*–14*d* are sections of tape supplies for use in the cassette of FIG. 10.

DESCRIPTION OF THE PREFERRED EMBODIMENTS

Figure 1:
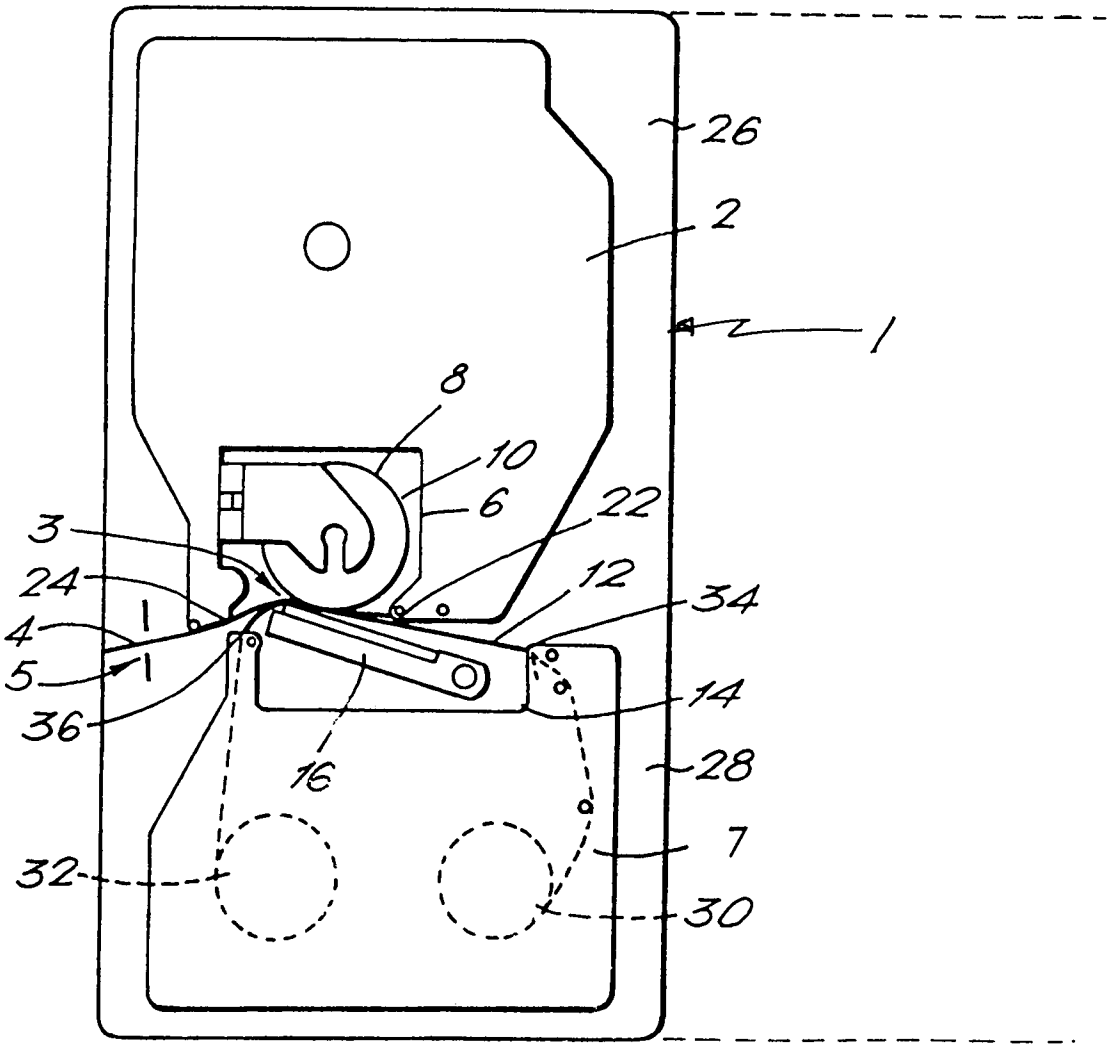
FIG. 1 is a plan view showing two cassettes inserted into a printing device.

FIG. 1 shows in plan view two cassettes arranged in a printing device 1. The upper cassette 2 is located in a first cassette receiving portion 26 and contains a supply of image receiving tape 4 which passes through a print zone 3 of the printer to an outlet 5 of the printer. At the outlet, a cutting mechanism is provided for cutting off printed portions of image receiving tape 4 in order to use them as a label. The image receiving tape 4 comprises an upper layer for receiving a printed image on one if its surfaces and having its other surface coated with an adhesive layer to which is secured a releaseable backing layer. The cassette 2 has a recess 6 for accomodating a platen 8 of the printer, and guide portions 22,24 for guiding the tape 4 through the print zone 3. The platen 8 is mounted for rotation within a cage moulding 10. As an alternative, the platen 8 could be mounted for rotation on a pin. The lower cassette 7 is located in a second cassette receiving portion 28 and contains a thermal transfer ribbon 12 which extends from a supply spool 30 to a take-up spool 32 within the cassette 7. The thermal transfer ribbon 12 extends through the print zone 3 in an overlap manner with the image receiving tape 4. The cassette 7 has a recess 14 for receiving a print head 16 of the printer and guide portions 34,36 for guiding the ink ribbon 12 through the print zone 3. The print head 16 is movable between an operative position, shown in FIG. 1, in which it is in contact with the platen 8 and holds the thermal transfer ribbon 12 and the image receiving tape in an overlap manner between the print head and the platen and an inoperative position in which it is moved away from the platen to release the thermal transfer ribbon and image receiving tape. In the operative position, the platen is rotated to cause image receiving tape to be driven past the print head and the print head is controlled to print an image onto the image receiving tape by thermal transfer of ink from the ribbon 12. The print head is a conventional thermal print head having an array of pixels each of which can be thermally activated in accordance with the desired image to be printed. The printing device has a lid which is not shown but which is hinged along the rear of the cassette receiving portion and which covers both cassettes when in place. A motor drives the platen 8 so that the image is printed print head column wise onto the image receiving tape 4. The platen 8 drives the image receiving tape through the print zone 3 under the action of its own rotation. The rotation of the platen and the energisation of the print head 16 are controlled by a microprocessor.

Figure 2:
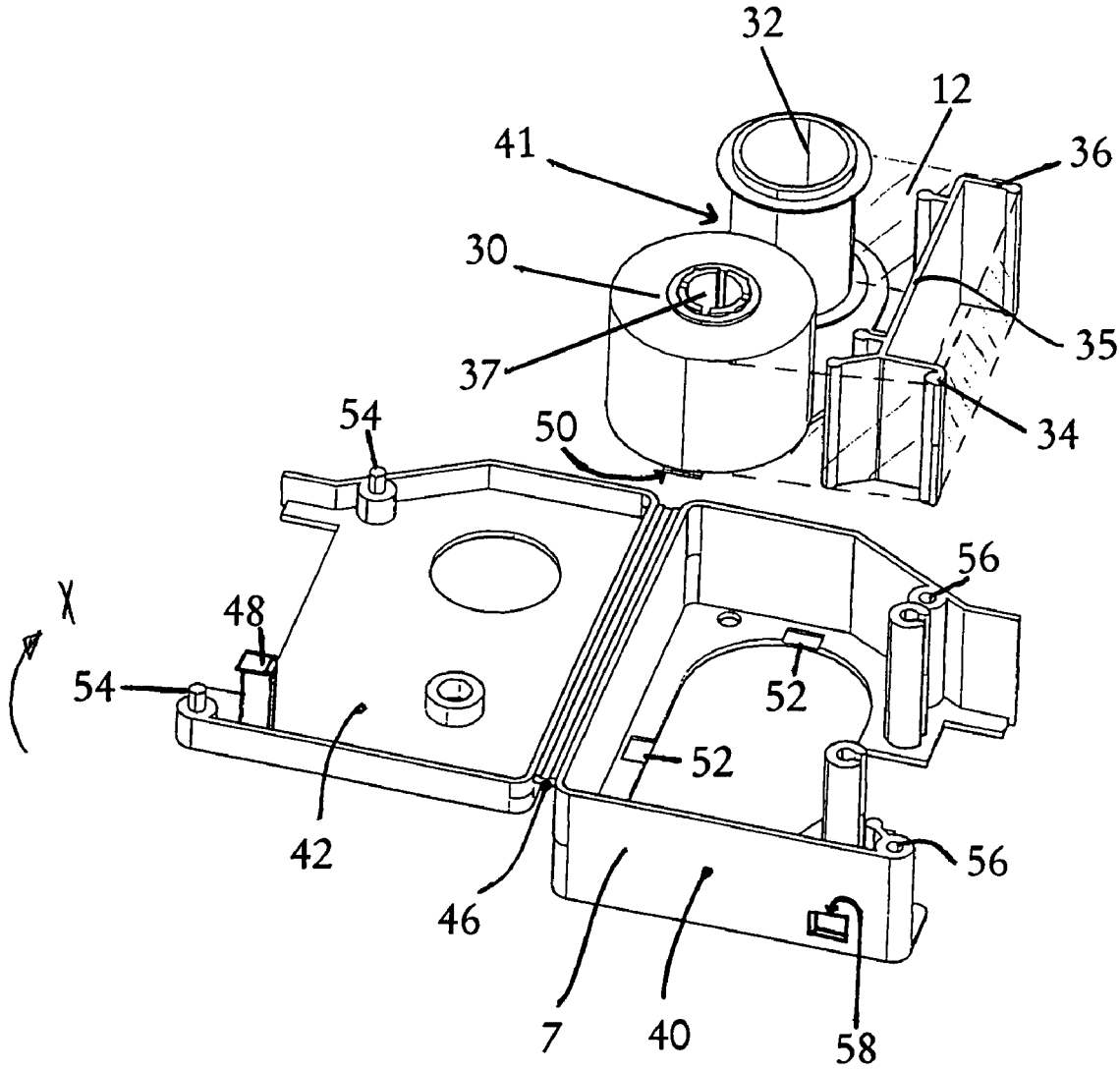
FIG. 2 is a perspective view of a cassette insertable into the printing device of FIG. 1.

In FIG. 2, an ink ribbon cassette for use in a printing device as shown in FIG. 1 is shown. The cassette 7 is refillable and has three key elements: a base 40, a lid 42, and a tape module 41. The lid 42 and base 40 are connected via a hinge 46. The tape module 41 comprises a plastic moulded frame 35, which supports acts as a holder by the ink ribbon tape supply spool 30, the tape take-up spool 32, and the guidances 34,36. Thus, the user can refill the cassette by opening the lid 42, removing and discarding the spent or empty tape module 41, and inserting a new tape module 41. The shown embodiment is designed for cassettes which house a single tape, such as the ink ribbon used in the printer of FIG. 1, and could alternatively or additionally accomodate the tape 4. Thus, a tape cassette could be produced with an arrangement corresponding to the cassette 2 shown in FIG. 1, hence containing only image receiving tape 4, or the cassette could accomodate ink ribbon and image receiving tape within the same housing, as the cassette shown in FIG. 7.

The base 40 and lid 42 are connected by the hinge 46 running along one edge of the base. In the illustrated embodiment, the hinge is a so-called "living" type hinge. The lid 42 and base 40 are formed as a single moulding with a bridge of material joining them along the hinged edge. The bridge has a relatively small wall thickness that will deform plastically if the lid portion is rotated in the direction shown by arrow "X", relative to the base portion 40. By selecting a plastic with a relatively high modulus of elasticity, a hinge can be made which will flex from the open to the closed position many times without breaking. Although a living hinge is the lowest cost and easiest to manufacture solution, many other types of hinges using separate lid, base and hinge components could also be used.

The lid 42 is located accurately to the base 40, as it is closed, by tapered alignment pins 54 which locate in alignment holes 56 of the 40 base. The lid 42 is retained by a clip or clips such as the clip 48 in the illustration, located in an opening or openings such as the opening in the base 40 denoted by reference numeral 58. When the cassette can accomodate different tape widths, it is possible to have a multiplicity of clips, whereby to each possible tape width one clip 48 is assigned, such that the respective clip fixes the lid 42 to the base 40. The base 40 further comprises recesses 52 for locating the tape module 41 as described below.

Turning now to the tape module 41, it comprises a plastic moulded frame 35, which is provided with support posts for the two tape spools 30,32, whereby the tape spools are assembled to the posts, and tape is wound onto one of the spools 30, with the leading end fixed to the second spool 32, when the ink ribbon tape is new, has thus not yet been used. When the tape is being used for printing, tape is unwound from the supply spool 30 and wound up on the take-up spool 32. The tape module 41 has protrusions 50 which match and/or mate with the recesses 52 in the base 40 of the cassette. The ink ribbon tape 12 is wound in position between the supply spool 30 and the cassette exit (which is located at the guide 34), and—after having passed the print zone 3—enters the cassette 7 again at the entrance located at the guide 36, from where it is guided towards the take-up spool 32. Tape tensioning and retention devices as described below are provided in order to keep the ink ribbon tape in position.

As a result, the tape module 41 can relatively simply be dropped into place in the cassette base 40 without effort or the need for complex instructions. After insertion, the lid 42 is closed over the tape module 41, and the clip 48 is latched into the corresponding hole 58. The tape module 41 is thereafter retained in the cassette 7 during use.

The tape 4 and/or the ink ribbon 12 are provided in "naked" units, i.e. without any additional housing, in order to avoid waste of material. A potential problem is thus that the tape could unintentionally unwind from the supply spool. Consequently, a strip of adhesive or a strip of wax is deposited radially on the top and/or bottom of the ink ribbon tape supply reel 30. This increases the force required to unravel the spool, thus preventing it from unwinding in storage (as a result of its own elasticity), but allows unwinding when driven in the printing device. Reference is made to FIGS. 3*a* and 3*b*, whereby FIG. 3*a* shows a side view, and FIG. 3*b* a top view. The strip is denoted by the reference numeral 60. Such a strip of adhesive or wax can be applied to either tape (ink ribbon 12 and image receiving tape 4), but is in reality most useful for the image receiving tape which is relatively stiff and has a strong tendency to uncoil if not prevented from doing so.

For correct operation of the printer, and in particular the avoidance of tape tracking problems, the tape must be kept under moderate tension when in use. This is achieved by resisting the rotation of the spool 30 as it unwinds. In FIG. 4 an arrangement for providing the necessary tension is shown. The plastic moulded frame 35 of the tape module 41 is provided with a stationary magnet 62 which is located at the center of the support post 37 for the ink ribbon supply spool 30. The support post 37 has a generally conical shape, wherein the largest diameter is facing the bottom of the frame 35. The ink ribbon tape supply spool 30 on the other hand is conical, as well, with the larger diameter facing towards the frame 35, and is provided with at least two spool magnets 64, which interact with the stationary magnet 62 and create an attraction between the spool 30 and the support post 37 of the frame 35. Thus, friction is created when the spool 30 rotates. The magnets 62 and 64 attract each other forcing the spool 30 down onto the frame 35. Consequently, the magnets 62, 64 fulfill two purposes; they keep the spool 30 in position, and provide the necessary tension for printing. The magnets are attached to, or moulded into, the two components, ie. the support post and the bobbin of the spool. The generated friction opposes the motion of the spool when the tape (4 or the ink ribbon 12) is pulled off it, and in so doing generates a tension in the tape. The back tension is important in preventing tape tracking problems with certain types of tape. It is also desirable when loading new tape modules into the cassette base, for the tape to remain taught as it is less likely then to snag on the cassette base features during insertion.

Similar solutions are shown in FIGS. 5 and 6. Here, the support post 37 for the ink ribbon tape supply spool 30 is however of a cylindrical shape (ie. not conically). As can be seen from FIGS. 5 and 6, the support post 37 can accomodate ink ribbon tape supply spools 30 with tape of different width. In FIG. 5, the width of the tape on the supply spool 30 is much broader than in FIG. 6. In order to maintain the same level of the center line of the tape independent on the width, the magnet 62 within the support post 37 is at the same level as the magnets 64 integrated into the supply spool 30. The level of the magnets 62,64 above the bottom of the frame 35 corresponds to the centerline of the ink ribbon tape. Thus, the magnets are used to position the spool 30 axially at the center of the support post 37. This is of benefit because a single cassette 2 or 7 or tape unit 41 could be refilled with tapes of different widths. The magnetic attraction between stationary magnets 62 and spool magnets 64 is sufficient to overcome the gravitational force acting on the spool, and prevent it from dropping to the bottom of the support post 37.

It should be noted that an arrangement corresponding to FIGS. 4 to 6 could be provided in a cassette 2 which only houses the image receiving tape 4, and for an image receiving tape 4 shown in the cassette of FIG. 7.

FIG. 7 illustrates in plan view a cassette bay of a printing device 1 according to a second embodiment of the present invention. The cassette receiving bay is shown by the dotted line 26. The cassette bay 26 includes a thermal print head 16 and a platen 8 which cooperated to define a print location 3 in a manner which is known in the art. The print head 16 is pivotable about a pivot point 72 so that it can be brought into contact with the platen 8 for printing and moved away from the platen 8 to enable a cassette to be removed and replaced.

A cassette inserted into the cassette receiving bay 26 is denoted generally by reference numeral 2. The cassette has a recess 14 for accomodating the print head 16 and holds a supply spool 70 of image receiving tape 4 which comprises an image receiving layer secured to a backing layer by a layer of adhesive. The image receiving tape 4 is guided by a guide mechanism (which is not shown) through the cassette 2 through an outlet, past the print location 3 to a cutting location C. The cassette 2 also has an ink ribbon supply spool 30 and an ink ribbon take up spool 18. The ink ribbon 12 is guided from the ink ribbon supply spool 30 through the print location 3 and taken up on the ink ribbon take up spool 32. The image receiving tape 4 passes in an overlap manner with the ink ribbon 12 through the print zone 3 with its image receiving layer in contact with the ink ribbon.

In the printing device illustrated in FIG. 7, the platen 8 is driven so that it rotates to drive the image receiving tape 4 past the print location P during printing. In this way, tape 4 is printed and fed out from the print zone 3 to the cutting location C. The cutting location C is provided at a location on a portion of the wall of the cassette 2 which is close to the print zone 3. The portion of the wall of the cassette 2 where the cutting location C is defined is denoted by reference numeral 74. A slot 76 is defined in this wall portion 74 and the image receiving tape 4 is fed past the print zone 3 to the cutting location C where it is supported by facing wall portions on either side of the slot 76. The printing device 1 includes a cutting mechanism 78. This cutting mechanism 78 includes a cutter support member 80 which carries a blade 82. The blade 82 has an angled and sharpened cutting edge. The blade 82 cuts the image receiving tape 4 and then enters the slot 76 with the leading part of its egde first, rather than bearing against an anvil. FIG. 7 shows the cutting mechanism 78 in its ready to cut state, that is with the blade 82 spaced from the tape 4. When the cutter support member 80 is depressed, the blade 82 is caused to be lowered until it is in contact with the tape 4. As the cutter support member 80 is further depressed, the blade 82 cuts the tape 4. When the cutter support member 80 is released, the cutting mechanism is in its ready-to-cut position under the action of springs.

FIG. 8 illustrates a first embodiment of a cassette 2 for use in the printing device 1 illustrated in FIG. 7. It comprises a base 40 which is provided with the features necessary for accomodating the tape 4 and the ink ribbon 12 separately. This cassette 2 has a refillable base with open reel modules and thus offers the user the ability to change the ink/substrate combination without buying a new cassette. For example, ink ribbons of different colours could be swapped at will, to allow different coloured text to be printed onto the same reel of image receiving tape. The embodiment illustrated in FIG. 8 has three main elements: a base 40, an ink ribbon module comprising an ink ribbon supply bobbin 106 and an ink ribbon take up bobbin 104, and an image receiving tape module comprising a tape bobbin 102. The bobbins 102, 104 and 106 are the cores onto which the tape 4, and the ink ribbon 12 is wound or gets wound during printing operations. When the ink ribbon is new, the bobbin 106 and the ink ribbon constitute the supply spool 30, and when it is used up, the bobbin 104 and the used ink ribbon make up the ink ribbon take-up spool 32.

The ink ribbon module is a supply bobbin 106 which is the core of the ink ribbon supply spool 30, onto which a length of unused ink ribbon is wound, and a take-up bobbin which is the core of the ink ribbon take-up spool 32, to which the outer end of the ink ribbon 12 is attached. The bobbins 104,106 and the ink ribbon 12 may be pre-assembled onto a housing moulding (as in the embodiment of FIG. 2 or onto a disposable holder (as in the embodiment of FIG. 10) to assist assembly, but in the illustrated embodiment of FIG. 8 the user is required to load the bobbins 104, 106 and to thread the ribbon 12 into position by hand. This means, that the inserted ink ribbon extends from the supply spool 30 on bobbin 106, which is located on a ink ribbon supply post 84 through an outlet 107 of the base 40, bridges the recess 14 and thus extends through the print zone 3, enters the base at an inlet 105 down-stream the cutter slot 76, and is then spooled up on ink ribbon take-up spool 32 on bobbin 104 which is supported on the ink ribbon take-up support post 86.

The image receiving tape module consists of a bobbin 102 onto which a length of image receiving tape 4 is wound, the bobbin 102 thus being the core of the image receiving tape supply spool 70 of FIG. 7. As with the ink ribbon, the tape module could include a plastic housing or holder to assist loading, but is shown here as an open reel. The bobbin 102 is accomodated on the image receiving tape support post 88. It should be noted that FIG. 8 shows a section through the bobbins 102, 104, 106, in order to make their interior visible. The tape 4 and ink ribbon 12 is removed, as well.

The tape and ink ribbon modules can be assembled into or removed from the base 40 whether the base 40 is in the printer 1 or not. The refillable base 40 is, in effect, an adaptor for the printer, allowing it to receive tape module refills.

Image receiving tapes and ink ribbons of different widths can be accomodated in the base, and positioned correctly in the vertical plane, by the use of a datum surface 94 at the base of each one of the support posts 84,86,88. Bobbins 102,104,106 of different length (the length corresponding to the tape width) each feature internal flanges 95 which are designed to sit on the datum surface 94 and hence provide support for the bobbin, positioned so that the center line of the tape 4 or ribbon 12 will alway lie in the same plane, regardless of its width. The different arrangements of steps in the bobbin bore shown give the appropriate centering height for each width of the tape.

As mentioned above, the support posts 84,86,88 support the image receiving tape bobbin 102 and ink ribbon bobbins 104, 106. They have clip or "bump" features in the form of an upstanding horizontal rib 92 which retain the bobbins after the latter are assembled into the base 40. The clip features are easily deformed to permit simple removal of used tape and ribbon bobbins. This is possible since the retention force required to prevent bobbins from riding up their support posts during printer operation, or to prevent them from dropping off the posts when installed in hand-held printers, is minimal. Each bobbin also has an internal flange at the correct height to mate with the retention rib 92 in the support post. In this way, different tape widths can be accomodated on the same base 40.

The ink ribbon supply bobbin 106 is provided with integral spring fingers, designed to be deformed when the bobbin 106 is assembled in the base 40. This is shown in FIGS. 9*a* and 9*b*, where such spring fingers 112 are shown. The bobbin 106 of the ink ribbon supply spool 30 has integral moulded curved spring fingers 112 in a plane perpendicular to the axis of the bobbin 106. These spring fingers 112 are deformed inwards when the bobbin is assembled in a cylindrical recess in the base 40. The recess could have a chamfered lead-in to draw the spring fingers 112 radially inwardly as the bobbin is inserted downwards. The springs cause friction when the bobbin 106 is turned, giving rise to tension in the ink ribbon 12 (or image receiving tape 4, when the spring fingers 112 are mounted to the image receiving tape supply spool bobbin 102) as it is pulled off the spool. The design of the spring fingers 112 (two or more are required) would be appropriate to avoid the danger of creep over the lifetime of the label printer. This may involve the selection of material. Polypropylene for example gives excellent creep resistance at high strain. Further, the shape has to be considered: a tapering spring with narrow tips will effectively spread the strain, rather than concentrating it at the root of the spring finger for example, and hence prolonging life. Tension is thus generated in the ink ribbon 12 as it is pulled off the supply spool 30, because of friction between the spring fingers 112 and the base, which opposes the rotation of the bobbin 106.

Turning now again to FIG. 8, the base 40 is a single plastic moulding or subassembly of components containing a selection of tape guides and support surfaces, support posts for tape and ribbon bobbins, a cutter interface; and interfaces for the other printer elements such as a tape size switch, printhead stop, and cassette retention clips. Whether the base 40 is a single plastic moulding, or a subassembly of two or more mouldings or other components depends upon manufacturing simplicity and cost considerations.

A feature of the base 40 is the guide walls 90. The base 40 contains a number of vertically upstanding walls which are required to guide and/or restrain the image receiving tape 4 and the ink ribbon 12, ensuring that they will follow the desired path between supply spools 70,30, printing location 3, take-up spool 32 (for the ink ribbon), and (for the image receiving tape) cutter and outlet positions. The location of the guide walls 90 is similar to those of known, non refillable tape cassettes.

Another feature moulded into the base is a tape size switch interface 98. This interface 98 is designed for interacting with a switch in the bottom of the cassette receiving portion 26 of the printing device 1, wherein cassettes housing tapes of different width require the switch to be moved into different positions, since the cassette can otherwise not be inserted properly. The switch is used to provide a controller of the printing device with information on the actual tape width. This switch is described in published European Patent EP-A-0 634 274. For variants of the cassette 2 which only accept a single tape width, a boxed recess is moulded into the floor of the base 40, shaped to fit over the printer's tape size switch with minimal clearance, and positioned so that the base cannot be assembled into a printer whose tape size switch is set incorrectly (ie. to a wrong tape width). Multiple tape width variants would not have this feature at all, such that the user would have to move the switch in cassette receiving portion into the appropriate position (while there is no interaction between the cassette housing and the switch), or would have it built into a module housing for the image receiving tape. The image receiving tape refill would therefore be supplied in a plastic housing containing the image receiving tape spool 70, location features for fitting it into the base 40, and the tape size switch interface 98, appropriately positioned.

Further, there is a pair of vertical walls on the base 40, which provide two surfaces besides the slot 76 against which the printer's cutter can act, and between which the cutter blade 82 can pass into the slot 76. The separation distance between these walls is critical to the successful operation of the cutter. The walls which make up the cutter slot 76 and the surfaces supporting the tape 4 during cutting could be replaceable. This has benefits because the cutter slot walls can become worn, which leads to diminished cutter performance. The cutter interface might therefore be built into the ink ribbon module, so that it would be replaced whenever the ink ribbon is replaced. The cutter slot walls would be part of the ink ribbon housing moulding, and would have location features to ensure that they were correctly aligned with the base. Walls in the base, behind the cutter area would provide support and enable the cutter walls to react the force applied by the cutter clamp. Alternatively, the cutter walls could be available independently for replacement as and when necessary, regardless of the tape usage.

A horizontal surface 100 is provided beneath the tape size switch interface 98, which is designed to interact with a printhead stop of the printer. Such a printhead stop is described more detailed in published European Patent EP-A-0 794 066. It interacts with the printhead holder, and prevents the printhead from getting in operative contact with the platen unless a cassette is inserted, in order to avoid deformation of the platen 8. The stop thus senses the presence of a cassette 2 in the cassette receiving portion 26. The horizontal surface 100 acts on the printhead stop in the printer, lowers it and allows the printhead to rotate freely into the operative position, ready for printing. The offset of the horizontal surface 100 from the floor of the base 40 is critical: too high, and the stop will not be fully disengaged; too low, and the base 40 will be held off the floor of the printer's cassette receiving portion 26.

The printers capable of accomodating the cassette 2 are all provided with a cassette retention clip mounted behind the printhead, at a height suitable for the cassettes, and a spring finger or cushion mounted on the lid of the cassette receiving portion, which acts on the top surface of an inserted cassette when the lid is closed. The refillable base 40 therefore features a horizontal surface 96, above the plane of the top surface of the tape and ink ribbon spools 30,32,70 against which these mechanisms can act and hold the cassette 2 in position in the printing device 1.

Another embodiment of a refillable tape cassette for use in the printing device of FIG. 7 is illustrated in FIG. 10. This embodiment is fundamentally a variation on the embodiment of FIG. 8. Whereas in the embodiment of FIG. 8 the cassette 2 has no lid or overall cover, and the bobbins are retained by clip features on their support posts, here they are retained by a floating lid 42 which makes contact with their top surfaces. The presence of the lid 42 has the benefit of preventing dust or other foreign bodies, which might cause print quality degradation, getting into the cassette. This embodiment has four main elements: a base 40, an ink ribbon module, an image receiving tape module, and the lid 42.

The base 40 is a single plastic moulding or subassembly of components containing a selection of tape guides and support surfaces, support posts 84,86,88 for tape and ribbon bobbins 102,104,106, a cutter interface, and interfaces for the tape size switch and printhead stop. Most of these features are similar to those of the embodiment shown in FIG. 8. Regarding the interface between base 40 and lid 42, some differences are to be mentioned: the external (circumferencial) walls of the base 40 are shorter than in FIG. 8. The lid 42 is connected to the base 40 by means of pins 128 of the base which protrude into corresponding holes 130 of the lid 42. The lid 42 is designed to drop over these pins 128 and to sit on top of the tape bobbins, when the cassette 2 is assembled. One central hole 132 in the lid 42 accomodates the tape supply support post 88. The lid 42 itself is retained by clip arms 48 which protrude upwards from the base 40. Since the lid 42 can in certain embodiments be accomodated in different heigths above the floor of the case 40, the clip 48 is then capable of accomodating the lid 42 at different heights, or alternatively the lid 42 is capable of accomodating the clip 48 at different heights. Such a retention is not necessary on the printhead side because it is provided by the cassette retention clips and/or springs in the printer, which have been discussed regarding the embodiment of FIG. 8. In this embodiment the lid 42 (instead of the horizontal surface 96 of the base 40 in FIG. 8) (alternatively it could be the ink module) provides a surface against which these mechanisms can act.

The ink ribbon module comprises a supply spool 30 on a bobbin 106, onto which a length of unused ribbon is wound, and a take-up spool 32 with a bobbin 104, to which the outer end of the ribbon is attached. The bobbins 104,106 and the ink ribbon 12 may be pre-assembled onto a housing or holder to assist assembly, as in the illustrated embodiment, where the bobbins 104,106 for the ink ribbon are mounted to a second lid or holder 120, and fixed to it by means of a tear-off tape 122. The second lid 120 thus carries the ink ribbon supply spool 30 and the ink ribbon take-up spool 32, and provides the necessary guidance for the ink ribbon 12, such that it can be inserted into the base 40, and the latter can be inserted into the printing device 1, without any difficulty. When the second lid 120 with the ink ribbon is loaded into the base 40, the tear-off tape 122 is removed and discarded, in order to allow the spools 30,32 to rotate. It would also be possible to remove and discard the entire second lid 120 holding the ink ribbon unit. Alternatively, the user could be required to load the bobbins and thread the ribbon into position by hand. The ink ribbon supply bobbin can be fitted in combination with a compression spring which is compressed when the bobbin is assembled in the base. This is shown in FIG. 11. Tension is then generated in the ink ribbon as it is pulled off the supply reel, opposing the rotation of the bobbin, because of friction between the spring and the base. The level of compression and hence back tension increases with larger ribbon widths. This has been shown to be benefical in practice. In FIG. 11*a*, a bobbin 102 with relatively wide image receiving tape is shown in a state when it is mounted onto the tape supply support post 88. In FIG. 11*b*, a bobbin 102 with medium wide image receiving tape is shown in a state when it is mounted onto the tape supply support post 88. In FIG. 11*c*, a bobbin 102 with relatively narrow image receiving tape is shown in a state when it is mounted onto the tape supply support post 88. In each of these Figures a spring 134 between the bobbin 102 and the mounting surface of the base 40 is compressed between the bottom flange of the bobbin 102 of the tape supply 70 and the floor of the base 40 of the cassette. This will create friction and hence tension when the tape 4 is pulled off the bobbin 102, turning the latter relative to the cassette 2. The friction produced will depend on the force applied and will thus be higher for the wide tape and least for the narrow tape. This is beneficial for the mechanical performance of the printer 1 since wider tape 4 requires a higher back-tension. Another arrangement utilising "living" springs made from the plastic moulding of the mounting part of the bobbin 102 is shown in FIGS. 12*a* and 12*b*. There, springs 135 extend downwardly from the tape flange of bobbin 102 adjacent the floor of the base 40, which are moulded by making plastic material of the flange extend downwardly. Corresponding arrangements as shown in FIGS. 11 and 12 can also be used for the ink ribbon supply spool 30 and the ink ribbon take-up spool 32.

Turning now again to FIG. 10, the image receiving tape module consists also of a supply bobbin 102 onto which a length of image receiving tape 4 is wound which constitutes the supply spool 70. As with the ink ribbon, the tape module could include a housing to assist loading, but is shown here as an open reel. It should be noted that FIG. 10 shows a section through the bobbins 102, 104, 106, in order to make their interior visible. The tape 4 and ink ribbon 12 is removed in the drawing for the sake of clarity, as well. The tape and ink ribbon modules can be assembled into or removed from the base 40 whether the base is in the printer or not.

The lid 42 is a plastic moulding, or could be stamped out from plastic or cardboard. Its purpose is to help retain the ink and tape bobbins, and to keep dust or other debris out of the tape paths. The embodiment of FIG. 10 could use a stamped cardboard lid which is extremely cheap to produce and which forms part of the retail packaging of the tape refill unit. A possible embodiment of this idea is illustrated in FIG. 10. The ink ribbon module is suppled on a cardboard or plastic holder (former) which holds the ink ribbon in approximately the right path for loading, and forms part of the cassette lid 42 after loading. The spools 30,32 are prevented from turning after loading, by adhesive tape 122 which is peeled off after the spools 30,32 on the bobbins 106, 104 have been dropped into the cassette base 40. The cardboard holder is removed and discarded when the ink ribbon 12 has been used up. Similarly, the substrate tape reel is supplied on a holder which, when loaded into the printer, forms the remainder of the lid.

Similar to the embodiment of FIG. 8, tapes 4 and ink ribbons 12 of different widths can be accomodated in the base, and positioned correctly in the vertical plane, by the use of a datum surface 94 on each of the support posts 84,86,88. This is performed in a manner described with respect to the embodiment of FIG. 8, and can be seen in FIG. 11.

Reference is now made to FIGS. 13*a* and 13*b*, which show an image receiving tape spool 70 in a side and a top view. In this arrangement, the image receiving tape 4 comprises a releasable backing layer 9, which has a width larger than the image receiving layer as such. This permits the axial ends of the supply spool 70 to be scuffed by a sharp object. This is performed in FIG. 13 at only one end, but could be done on both ends, as well. Further, scuffing can be performed across a radius or a diameter, or a plurality of radii. The image receiving layer is unaffected as the damage is limited to the edges of the backing tape. This effectively mechanically links each coil of image receiving tape 14 ot its neighbours and will hinder unwinding, hence making storage and handling easier. It should be noted that the image receiving tape 14 could be manufactured without backing paper. The adhesive on the back of the tape would hold it when coiled until sufficient force was applied to unwind it, giving it a safe storage security.

FIGS. 14*a*–14*d* show another embodiment of a refillable tape cassette. The base 40 of the cassette is the same as shown in FIG. 10; however the lid 42 does not float (i.e. vary its height over the floor of the base with the tape width). Instead, the lid 42 contains packing material to bridge the gap between the top of the tape spools 70 and the top of the base 40 moulding's outer walls. This means that the top surface of the cassette assembly is always in the same plane, for all tape sizes. Thus, lid retention is simplified compared to the embodiment of FIG. 10, because the clip arm 48 (or arms) only need to accomodate one lid position.

The invention claimed is:

1. A tape cassette for accommodating a supply of printable tape and suitable for being detachably loaded in a tape printing device, the tape cassette having: means for inserting and removing a tape supply into said tape cassette; and means whereby said tape cassette selectively accommodates tape supplies of different tape width, said tape cassette further having: a housing; and a spring located between a respective bobbin and a part of said housing, said spring slipping on one of said housing and said bobbin and providing a back tension to the tape of the bobbin with which it is located, wherein each bobbin includes a flange, wherein each spring interacts with said flange of the bobbin with which it is located, and wherein the relative position of said flange with respect to its associated post, and thus the backward tension applied to the tape by said associated spring is a function of the width of the tape.

2. The tape cassette according to claim 1, wherein said means for inserting and removing comprises a plurality of posts and an equal plurality of bobbins releasably accommodated on a respective one of said posts, each of said bobbins defining a surface and each of said posts having a datum surface which interacts with said surface of the bobbin such that it defines the position of said bobbin in the axial direction of said post.

3. The tape cassette according to claim 2, wherein tapes of different widths are associated with said bobbins, the tapes defining a center line, and wherein said surfaces of said bobbins are positioned so that the center line of the tapes is located in the same plane intersecting said surfaces of said bobbins, independent of the width of the tape.

4. The tape cassette according to claim 2, wherein each of said bobbins defines an internal flange, and wherein a rib is defined by one of said posts and bobbins which nb mates with said internal flange of said bobbin so that said bobbin is releasably retained on its respective post.

5. The tape cassette according to claim 4, wherein tapes of different widths are associated with said bobbins, the tapes defining a center line, and wherein said surfaces of said bobbins are positioned so that the center line of the tapes is located in the same plane intersecting said surfaces of said bobbins independent of the width of the tape.

6. The tape cassette according to claim 1, said tape cassette further having means for supporting the tape supply, wherein the tape is at least one of an ink ribbon tape and an image receiving tape, and wherein said image receiving tape comprises an image receiving layer and a releasable backing layer.

7. The tape cassette according to claim 6, wherein said means for inserting and removing includes a supply spool and a take-up spool, and a holder, said supply spool and said take-up spool being fixed to said holder such that their relative position corresponds to their position when they are inserted in said tape cassette, and wherein said ink ribbon is provided on said supply spool and said take-up spool.

8. The tape cassette according to claim 7, wherein said holder comprises means for defining a path for said ink ribbon tape, said defined path corresponding to the path of said ink ribbon when it is inserted into said tape cassette.

9. The tape cassette according to claim 7, wherein said supply spool and said take-up spool for said ink ribbon are releasably secured by said holder against rotation, such that said tape cassette is in an operable state when said ink ribbon is mounted in said tape cassette, but released from said holder.

10. The tape cassette according to claim 1, wherein each spring is unitary with one of said bobbin and said housing.

11. A tape cassette for accommodating a supply of printable tape and suitable for being detachably loaded in a tape printing device, the tape cassette having: means for inserting and removing a tape supply into said tape cassette; and means whereby said tape cassette selectively accommodates tape supplies of different tape width, said tape cassette further having: a housing including a base on which the tape supply can be releasably fixed, said base having a bottom surface which extends orthogonally to a center plane of said tape supply, said tape supply being releasably retained on said bottom surface, and wherein said tape supply is freely accessible from the side of said base opposite to said bottom surface, said tape cassette having thereby the form of an open chassis, said tape cassette further having: a lid situated opposite to said bottom surface, and wherein the distance between said bottom surface and said lid varies with the width of the tape.

12. A tape cassette for accommodating a supply of printable tape and suitable for being detachably loaded in a tape printing device, the tape cassette having: means for inserting and removing a tape supply into said tape cassette; and means whereby said tape cassette selectively accommodates tape supplies of different tape width, said tape cassette further having means for supporting the tape supply, wherein the tape is at least one of an ink ribbon tape and an image receiving tape comprising an image receiving layer and a releasable backing layer, wherein said means for inserting and removing includes a supply spool and a take-up spool, and a holder, said supply spool and said take-up spool being fixed to said holder such that their relative position corresponds to their position when they are inserted in said tape cassette, and wherein said ink ribbon is provided on said supply spool and take-up spool, and wherein said holder comprises a lid covering at least a part of said tape cassette.

13. The tape cassette according to claim 12, said tape cassette further having: a housing including a base on which the tape supply can be releasably fixed, said base having a bottom surface which extends parallel to a center plane of said tape supply, and a lid situated opposite to said bottom surface, and wherein said tape supply is releasably fixed to said lid.

14. The tape cassette according to claim 12, the tape cassette having: a housing comprising a base on which the tape supply can be releasably fixed, a hinge, and a lid fixed to said base by means of said hinge, said base, said lid, and said hinge formed to be unitary.

15. A tape cassette for accommodating a supply of printable tape and suitable for being detachably loaded in a tape printing device, the tape cassette having: means for inserting and removing a tape supply into said tape cassette; means whereby said tape cassette selectively accommodates tape supplies of different tape widths; and a spring located between a bobbin and a part of said housing, said spring slipping on one of said housing and said bobbin and providing a back tension to the tape of the bobbin with which it is located, wherein: each bobbin includes a flange, and each spring intersects with said flange of the bobbin with which it is located; and wherein the relative position of said flange with respect to its associated post, and thus the backward tension applied to the tape by said associated spring is a function of the width of the tape.

16. The tape cassette according to claim 15, wherein each spring is unitary with one of said associated bobbin and said housing.

17. The tape cassette according to claim 15, said tape cassette further having: a housing including a base on which the tape supply can be releasably fixed, said base having a bottom surface which extends orthogonally to a center plane of said tape supply, said tape supply being releasably retained on said bottom surface, and wherein said tape supply is freely accessible from the side of said base opposite to said bottom surface, said tape cassette having thereby the form of an open chassis.

18. A tape cassette for accommodating a supply of printable tape and suitable for being detachably loaded in a tape printing device, the tape cassette having: means for inserting and removing a tape supply into said tape cassette; means whereby said tape cassette selectively accommodates tape supplies of different tape width; a housing including a base on which the tape supply can be releasably fixed, said base having a bottom surface which extends orthogonally to a center plane of said tape supply, said tape supply being releasably retained on said bottom surface; and a lid situated opposite to said bottom surface, wherein said tape supply is freely accessible from the side of said base opposite to said bottom surface, said tape cassette having thereby the form of an open chassis, and wherein the distance between said bottom surface and said lid varies with the width of the tape.

19. The tape cassette according to claim 18, said tape cassette further having: a pin, wherein one of said base and said lid has a hole for accommodating said pin, said pin serving to guide said lid relative to said base.

20. The tape cassette according to claim 18, said tape cassette further having: at least one clip for securing said lid to said base, wherein said clips are located on one of said lid and said base, and wherein said clips interacts with a surface on one of said lid and said base and said interaction is a function of the tape width.

21. A tape cassette for accommodating a supply of printable tape and suitable for being detachably loaded in a tape printing device, the tape cassette having: means for inserting and removing the tape supply into said tape cassette; means whereby said tape cassette selectively accommodates tape supplies of different tape widths; tear-off tape; and means for supporting the tape supply, wherein: the tape is at least one of an ink ribbon tape and an image receiving tape, said image receiving tape comprising an image receiving layer and a releasable backing layer; said means for inserting and removing includes a supply spool and a take-up spool, and a holder; said supply spool and said take-up spool being fixed to said holder such that their relative position corresponds to their position when they are inserted in said tape cassette; said ink ribbon is provided on said supply spool and said take-up spool; said supply spool and said take-up spool for said ink ribbon are releasably secured by said holder against rotation, such that said tape cassette is in an operable state when said ink ribbon is mounted in said tape cassette, but released from said holder, and wherein said supply spool and said take-up spool of said ink ribbon are fixed to said holder by said tear-off tape.

* * * * *

UNITED STATES PATENT AND TRADEMARK OFFICE

CERTIFICATE OF CORRECTION

PATENT NO. : 7,097,372 B1
APPLICATION NO. : 09/182499
DATED : August 29, 2006
INVENTOR(S) : Geert Heyse et al.

It is certified that error appears in the above-identified patent and that said Letters Patent is hereby corrected as shown below:

Title Page
Column 1
Field (73) Assignee

Line 1 Please delete "Esselte N.V." and replace with --DYMO--.

Signed and Sealed this

Twenty-first Day of August, 2007

JON W. DUDAS
*Director of the United States Patent and Trademark Office*